US006071076A

United States Patent [19]

Ansari et al.

[11] Patent Number: 6,071,076

[45] Date of Patent: Jun. 6, 2000

[54] ACTUATION SYSTEM FOR A GAS TURBINE ROTOR BLADE

[75] Inventors: M. Kaleem Ansari, West Chester; Thomas Moniz, Loveland; August H. Kramer; Anant P. Singh, both of Cincinnati, all of Ohio

[73] Assignee: General Electric Company, Cincinnati, Ohio

[21] Appl. No.: 08/991,053

[22] Filed: Dec. 16, 1997

[51] Int. Cl.[7] ..... B64C 11/32

[52] U.S. Cl. ..... 416/168 R; 416/165; 416/167; 416/174; 416/205

[58] Field of Search ..... 416/167, 165, 416/164, 244 A, 168 R, 174, 205

[56] References Cited

U.S. PATENT DOCUMENTS

| | | | |
|---|---|---|---|
| 3,869,221 | 3/1975 | Wildner | 416/168 R |
| 3,873,236 | 3/1975 | Gall | 416/168 R |
| 3,994,128 | 11/1976 | Griswold, Jr. et al. | 416/165 |

*Primary Examiner*—F. Daniel Lopez
*Assistant Examiner*—Richard Woo
*Attorney, Agent, or Firm*—Andrew C. Hess; William S. Andes

[57] ABSTRACT

An actuation system which includes apparatus for transferring control signals for varying the blade pitch from a non-rotating member to a rotating member of a gas turbine engine is described. In one embodiment, the engine includes a main disk containing a row of blades, and the disk is coupled to a main shaft which rotates about the engine axis. An actuating disk, or cone, rotates with the main disk, and the torque required to rotate the actuating cone is transmitted through ball splines attached to the main shaft. The ball splines allow transmission of torque between the disk and the cone and at the same time enable the disk and the cone to move axially relative to each other without binding. The actuating cone is supported at one end by the ball splines and at its other end by ball thrust bearings. The ball thrust bearings are pre-loaded to enable the bearings to withstand axial loads in opposite directions. The outer races of the bearings are supported by a ring, and the ring is connected to an actuator through a connecting cone. In addition to the actuating system, a blade support system is provided wherein the load of the blade is transferred from a blade "button" head to the main disk through a load transfer ring, a bearing inner race support, and a thrust bearing. A nut retains a crank of the actuating system on the blade spindle. To rotate the blade about its radial axis, the ring is moved axially by the actuator. Such axial movement of the ring imparts axial motion to the rotating actuating cone, which rotates a crank attached to the blade. The thrust bearings allow the actuating cone to rotate about the centerline of the actuator and to move axially when actuated.

24 Claims, 7 Drawing Sheets

ACTUATION SYSTEM FOR A GAS TURBINE ROTOR BLADE

GOVERNMENT RIGHTS

The United States Government has rights in this invention pursuant to Contract No. N00024-94-C-4015 awarded by the Department of the Navy.

FIELD OF THE INVENTION

This invention relates generally to gas turbine engines and, more particularly, to actuating systems for rotor blades in such engines.

BACKGROUND OF THE INVENTION

Gas turbine engines generally include a high pressure compressor for compressing air flowing through the engine, a combustor in which fuel is mixed with the compressed air and ignited to form a high energy gas stream, and a high pressure turbine. The high pressure compressor, combustor and high pressure turbine sometimes are collectively referred to as the core engine. Such gas turbine engines also may include a low pressure compressor, or booster, for supplying compressed air, for further compression, to the high pressure compressor.

Gas turbine engines are used in many applications, including in aircraft and in ships. The desired engine operating characteristics vary, of course, from application to application. For example, in some gas turbine engine applications, it often is necessary during engine operation to selectively actuate some variable geometry component which is mounted on the engine rotor. For example, in a variable pitch fan type aircraft engine, the fan blade pitch often must be continuously adjusted to meet the flight mission requirements. Boosters with variable rotor blades also may be utilized.

Actuating a rotor blade is difficult in that the control signal for varying the blade pitch must originate from a non-rotating area of the engine and then be transferred across the boundary to the rotating components. In addition, adequate blade support is required which would sustain the blade loads and at the same time allow the blade to rotate along its radial axis. It would be desirable to provide a simple and reliable actuation system for the rotor of a gas turbine engine.

SUMMARY OF THE INVENTION

These and other objects may be attained by an actuation system which includes apparatus for transferring control signals for varying the blade pitch from a non-rotating member to the rotating member of the engine. More particularly, and in one embodiment, the engine includes a main disk containing a row of blades, and the disk is coupled to a main shaft which rotates about the engine axis. An actuating disk, or cone, rotates with the main disk, and the torque required to rotate the actuating cone is transmitted through ball splines attached to the main shaft. The ball splines allow transmission of torque between the disk and the cone and at the same time enable the disk and the cone to move axially relative to each other without binding.

The actuating cone is supported at one end by the ball splines and at its other end by ball thrust bearings. The ball thrust bearings are pre-loaded to enable the bearings to withstand axial loads in opposite directions. The outer races of the bearings are supported by a ring, and the ring is connected to an actuator through a connecting cone.

In addition to the actuating system, a blade support system is provided wherein the load of the blade is transferred from a "button" head to the main disk through a load transfer ring, a bearing inner race support, and a grease pack thrust bearing. The blade support assembly ensures that the blade loads are not transferred to the threads on the blade spindle. A nut retains a crank of the actuating system on the blade spindle.

To rotate the blade about its radial axis, the ring is moved axially by the actuator. Such axial movement of the ring imparts axial motion to the rotating actuating cone, which rotates a crank attached to the blade. The thrust bearings allow the actuating cone to rotate about the centerline of the actuator and to move axially when actuated.

The above described actuating system enables transmission of a control signal for varying the blade pitch from a non-rotating area of the engine across a boundary to the rotating components. In addition, adequate blade support is provided to sustain the blade loads and at the same time allow the blade to rotate along its radial axis.

DETAILED DESCRIPTION

Generally, to provide a variable rotor blade in a gas turbine engine, the blade must be supported in the main rotor disk and the blade must be rotatable along its radial axis. In addition, other factors to consider are the direction of actuating disk/cone motion i.e., circumferential or axial or combination of circumferential and axial, and the actuator arrangement and type. For example, the actuator arrangement can be rotary or stationary (axial) and the actuator may be hydraulic, pneumatic, electric, electromagnetic or centrifugal.

In addition, many variables should be taken into consideration when configuring such an actuation system. For example, if the actuator disk/cone moves axially and the actuator is stationary i.e., does not rotate but provides axial motion only, the connection between the main rotor disk and the rotating actuation disk/cone should transmit torque and at the same time allow smooth axial movement of the actuation disk/cone. Similarly, the connection between the rotating actuation disk/cone and the non-rotating actuator should allow transmission of axial motion of the actuator to the rotating actuation disk/cone precisely and without binding.

Figure 1:
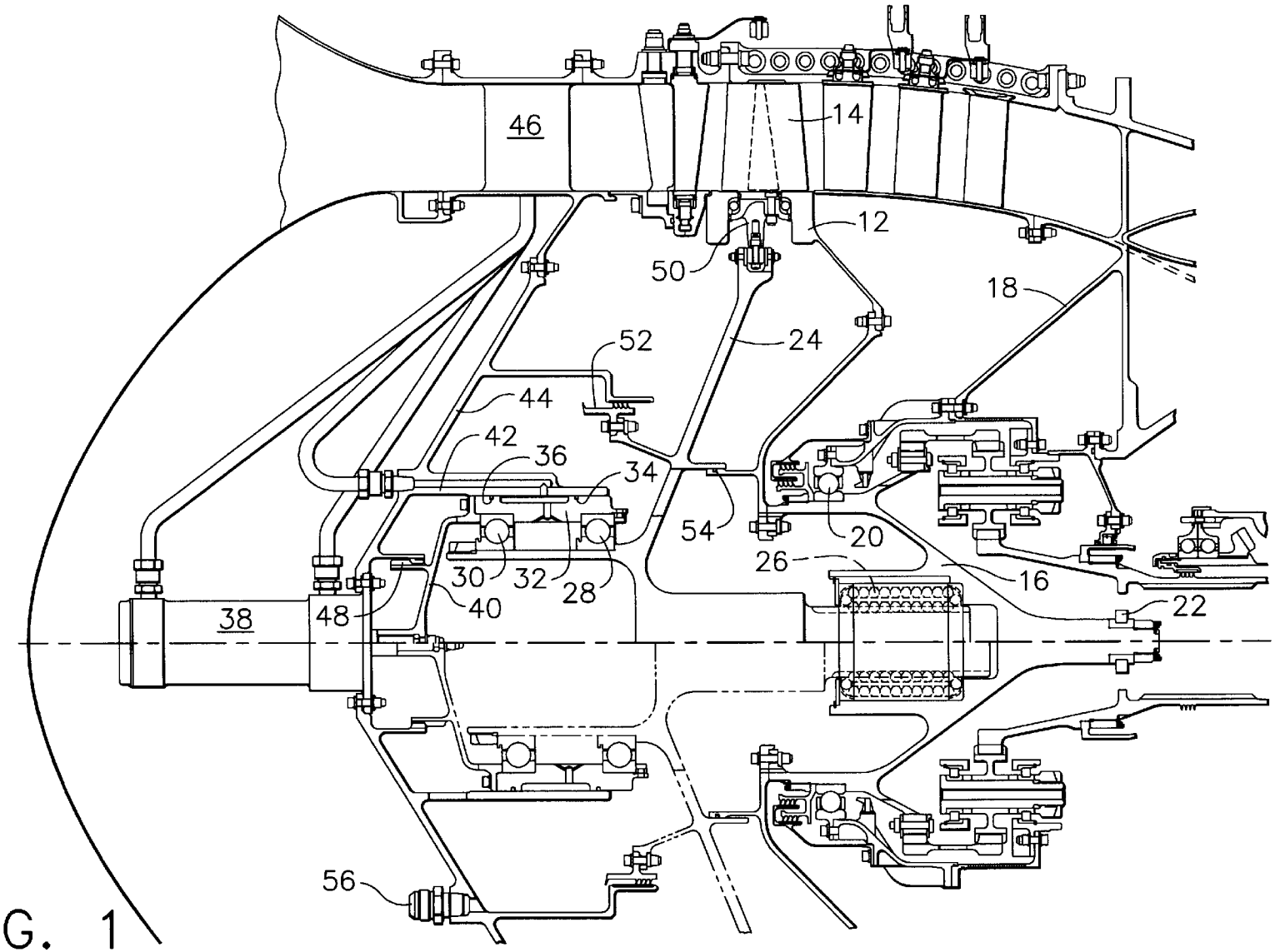
FIG. 1 is a schematic illustration of a rotor blade actuation system in accordance with one embodiment of the present invention.

FIG. 1 is a schematic illustration of a rotor blade actuation system 10 in accordance with one embodiment of the present invention. As shown in FIG. 1, a main disk 12 contains a row of blades 14 and disk 12 is coupled to a main shaft 16 which rotates about the engine axis. Disk 12 is supported by a main frame 18 and a combination of a thrust bearing 20 and a roller bearing 22. An actuating disk, or cone, 24 rotates with main disk 12, and the torque required to rotate actuating cone 24 is transmitted through ball splines 26 attached to main shaft 16. Ball splines 26 allow transmission of torque between disk 12 and cone 24 and at the same time enables disk 12 and cone 24 to move axially relative to each other without binding.

Actuating cone 24 is supported at one end by ball splines 26 and at its other end by ball thrust bearings 28 and 30. Ball thrust bearings 28 and 30 are pre-loaded to enable bearings 28 and 30 to withstand axial loads in opposite directions. The outer races of bearings 28 and 30 are supported by a ring 32 containing ring seals 34 and 36. Ring 32 is connected to an actuator 38 through a connecting cone 40. A cylinder 42, which is a component of engine support structure 44 and 46, at least partially encloses bearings 28 and 30, and ring 32. A spline 48 is provided to prevent rotation of ring 32.

To rotate blade 14 about its radial axis, ring 32 is moved axially by actuator 38. Such axial movement of ring 32 imparts axial motion to rotating actuating cone 24, which rotates a crank 50 attached to blade 14. Thrust bearings 28 and 30 allow actuating cone 24, to rotate about the centerline of actuator 38 and to move axially when actuated. Seals 52 and 54 allow a separate sump to be formed from the main engine for bearings 28 and 30 and ball splines 26. The sump is scavenged through an outlet 56.

Figure 3:
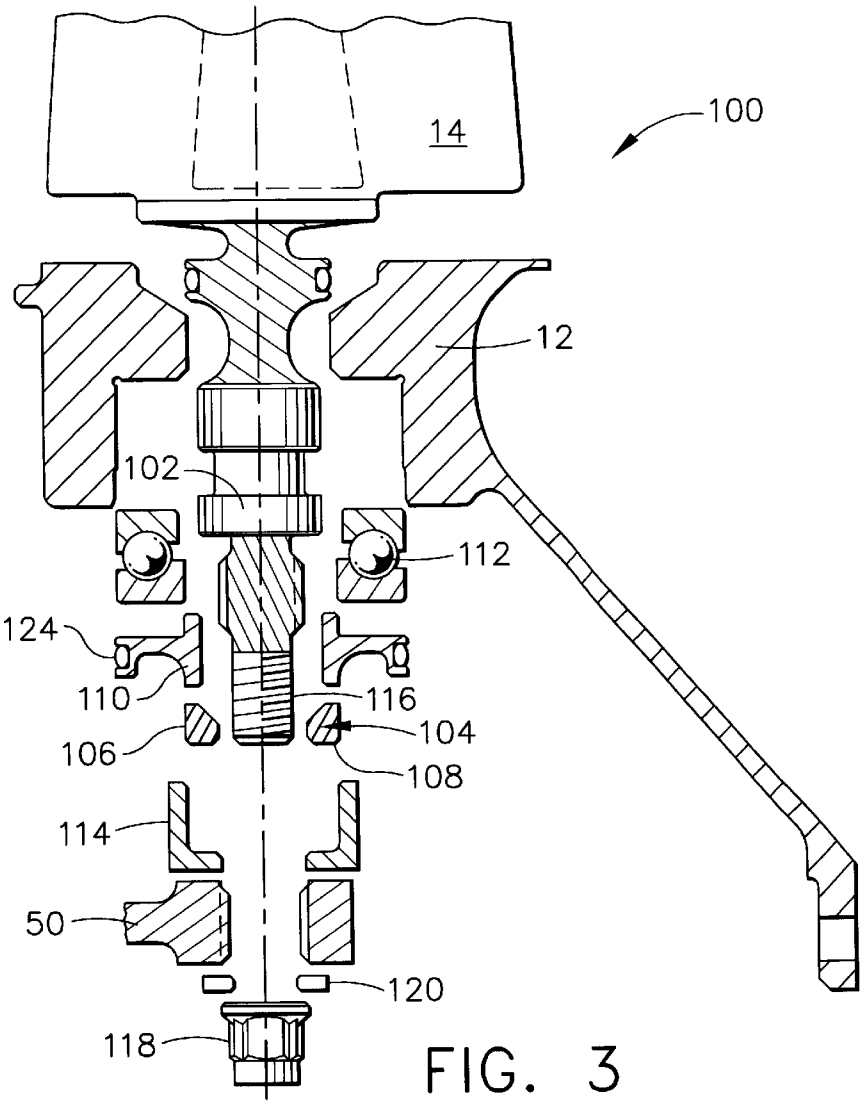
FIG. 3 is an exploded view of the blade support assembly shown in FIG. 2.
Figure 2:
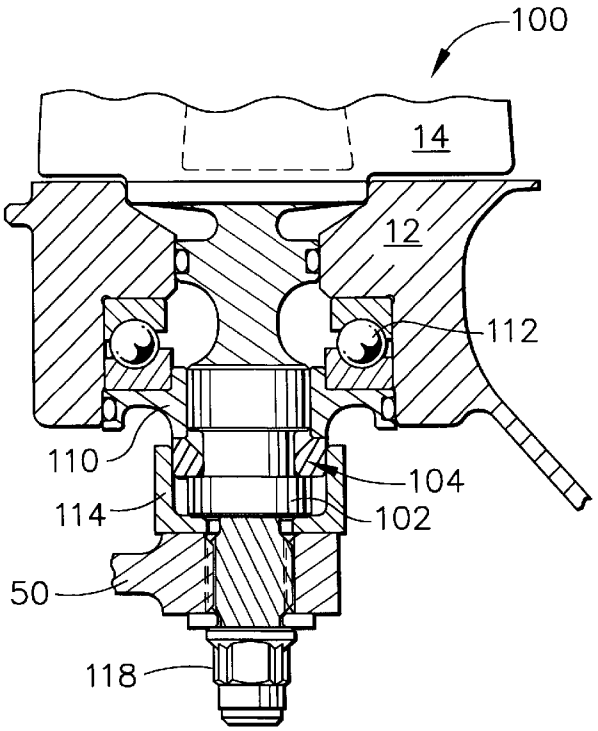
FIG. 2 is a side view of a blade support assembly in accordance with one embodiment of the present invention.

FIG. 2 is a side view of a blade support assembly 100 used in connection with actuating cone 24, and FIG. 3 is an exploded view of blade support assembly 100. Blade support assembly 100 transfers the blade load to rotating disk 12 and enables blade 14 to rotate along its radial axis. More particularly, and referring to FIGS. 2 and 3, the load of blade 14 is transferred from a "button" head 102 to main disk 12 through a load transfer ring 104 having first and second ring sections 106 and 108, a bearing inner race support 110 and a grease pack thrust bearing 112. A retaining ring 114 maintains engagement of the sections 106 and 108 of load transfer ring 104. Blade support assembly 100 ensures that the blade loads are not transferred to the threads on a blade spindle 116. A nut 118 and washer 120 retains crank 50 and retaining ring 114 on blade spindle 116. "O" rings 122 and 124 are provided to keep contaminants away from thrust bearing 112.

The above described actuating system and blade support assembly enable the transmission of torque from the main rotor disk to the rotating actuation cone and at the same time allow smooth axial movement of the actuation cone. In addition, the connection between the rotating actuation cone and the non-rotating actuator allows transmission of axial motion of the actuator to the rotating actuation cone precisely and without binding.

Figure 4:
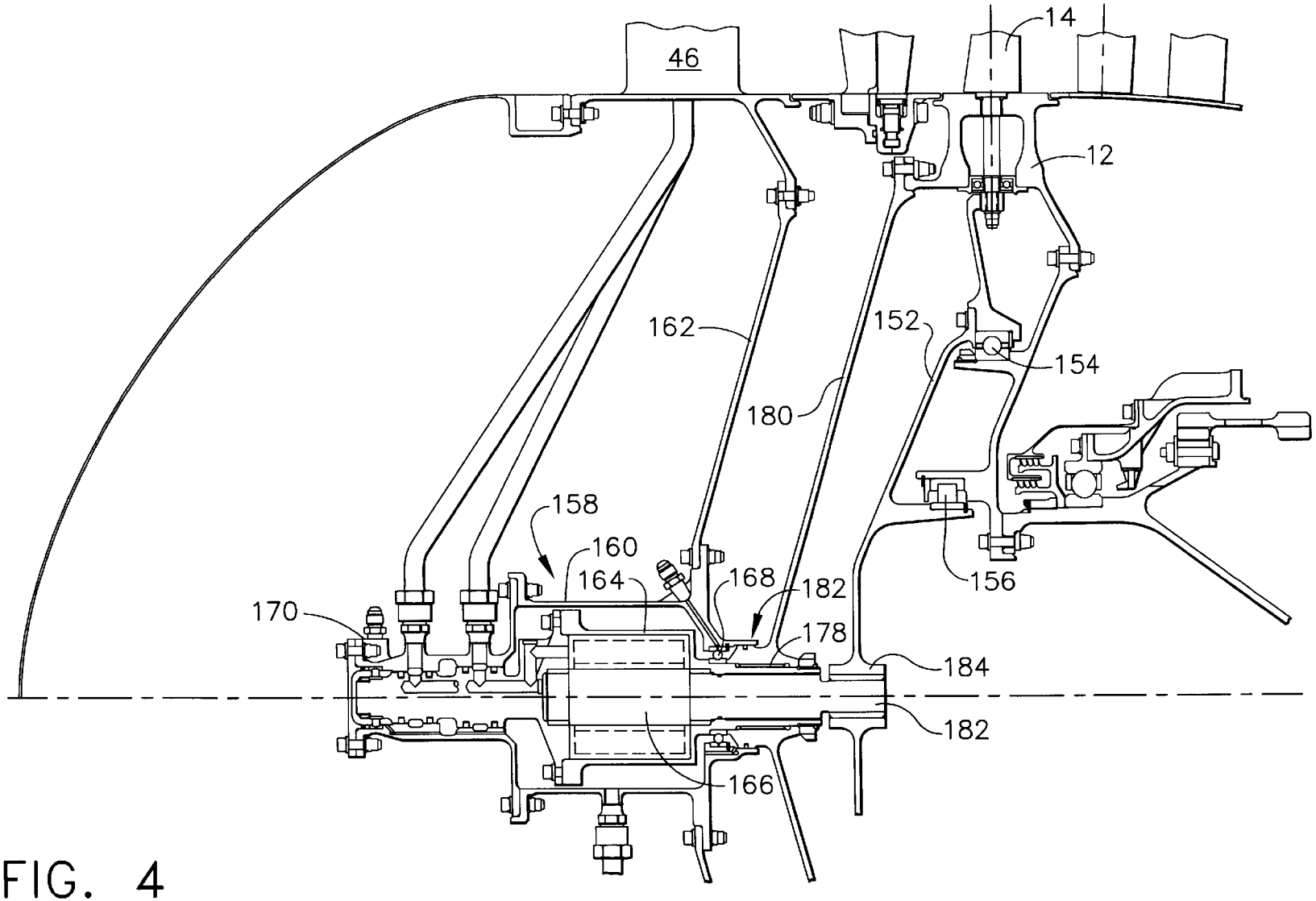
FIG. 4 is a schematic illustration of a rotor blade actuation system in accordance with another embodiment of the present invention.

FIG. 4 is a schematic illustration of a rotor blade actuation system 150 in accordance with another embodiment of the present invention. With system 150, and to rotate the blade 14 about its radial axis, an actuation cone 152 is moved in the circumferential direction instead of the axial as in system 10. Particularly, actuation cone 152 rotates with main disk 12 and is supported by a ball bearing 154 and roller bearing 156. Bearings 154 and 156 enable actuation cone 152 to move circumferentially relative to main disk 12. An actuator 158 includes a body 160 attached to frame 46 through a support cone 162 and concentric rotors 164 and 166 located within actuator body 160 and supported by bearings 168 and 170. Rotors 164 and 166 rotate with main disk 12.

Figure 5:
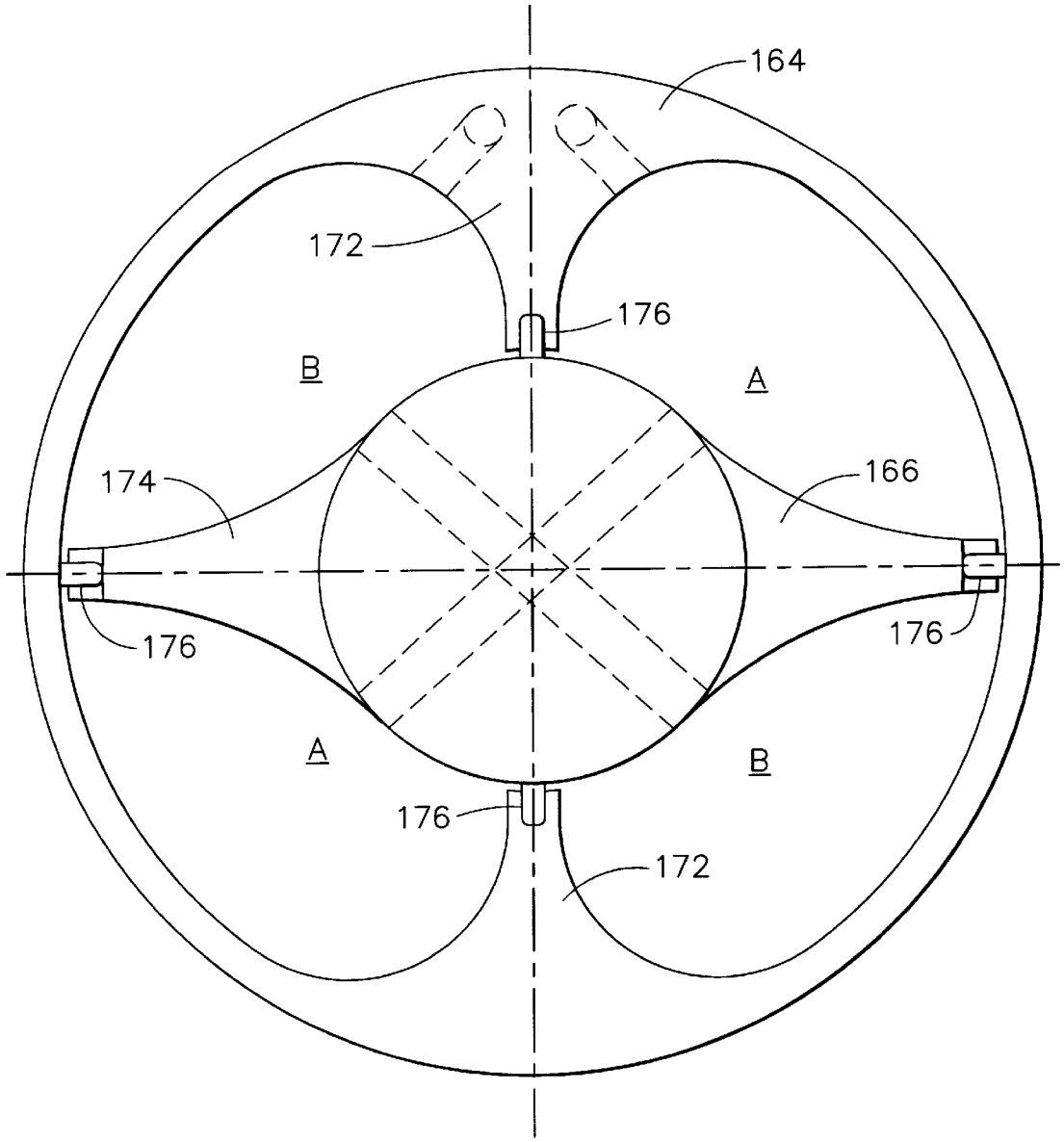
FIG. 5 is a cross sectional front view of the actuator used in the actuation system shown in FIG. 4.

Referring now to FIG. 5, rotor 164 contains two inward pointing lobes 172 and rotor 166 has two outward pointing lobes 174 so when rotors 164 and 166 are assembled, chambers AA and BB are formed. Adequate sealing by gaskets 176 is provided to prevent any leakage between chambers A and B. Rotor 164 forward end shaft has two oil passages to bring in high pressure oil to chambers AA & BB.

As shown in FIG. 4, an aft shaft 178 of rotor 164 is connected to a drive cone 180 through a spline arrangement 182. Rotor 166 is contained within rotor 164 and is supported on self lubricating journal bearings. Aft shaft 178 of rotor 166 couples to actuation cone 152 through splines 184. Drive cone 180 is bolted to main disk 12 and provides the necessary torque to rotate rotors 164 and 166 with main disk 12.

During normal operation, actuation cone 152, drive cone 180 and rotors 164 and 166 rotate about the engine axis at the same speed and direction as main disk 12. To actuate blade 14, a pressure differential is created between chambers AA and BB, and such pressure differential produces the force and circumferential movement of actuation cone 152, relative to the rotating assembly, to actuate blade 14.

Figure 6:
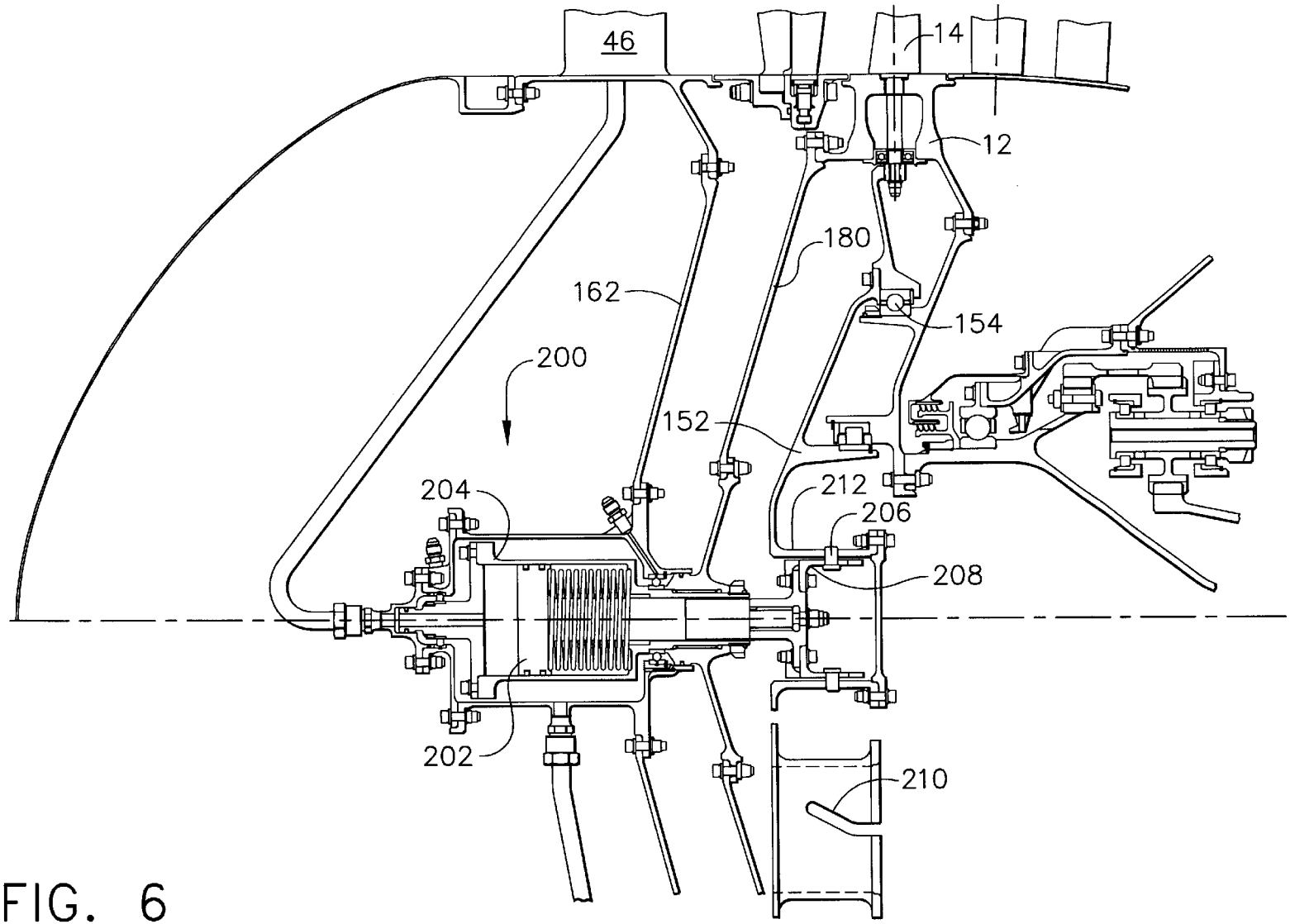
FIG. 6 is a schematic illustration of a linear actuator that may be used in connection with the systems shown in FIGS. 1 and 4.
Figure 7:
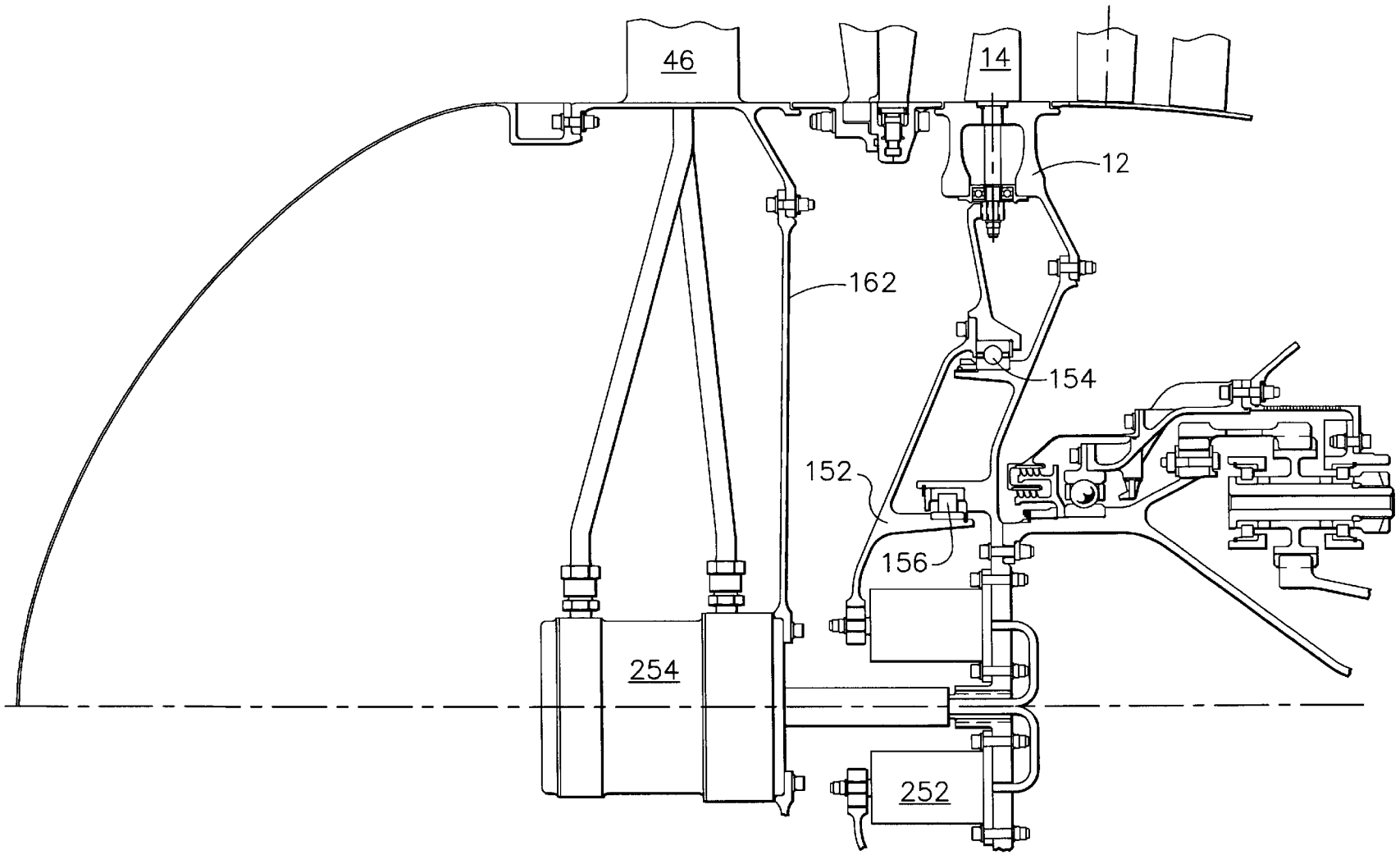
FIG. 7 is a schematic illustration of another actuator that may be used in connection with the systems shown in FIGS. 1 and 4.

FIGS. 6 and 7 illustrate different types of actuators. Particularly, FIG. 6 illustrates an actuator 200 including a piston 202 contained within a rotating cylinder 204. Blade actuation is accomplished by converting axial motion of piston 202 into rotary motion by the axial movement of radially projecting pins 206 contained in a ring 208 attached to piston 202, in angled grooves 210 in a cylinder 212 attached to actuation cone 152.

FIG. 7 illustrates an actuator 250 including electric motors 252. Actuation cone 152 is driven directly by electric motors 252. Power to electric motors 252 is supplied through slip rings 254.

Figure 8:
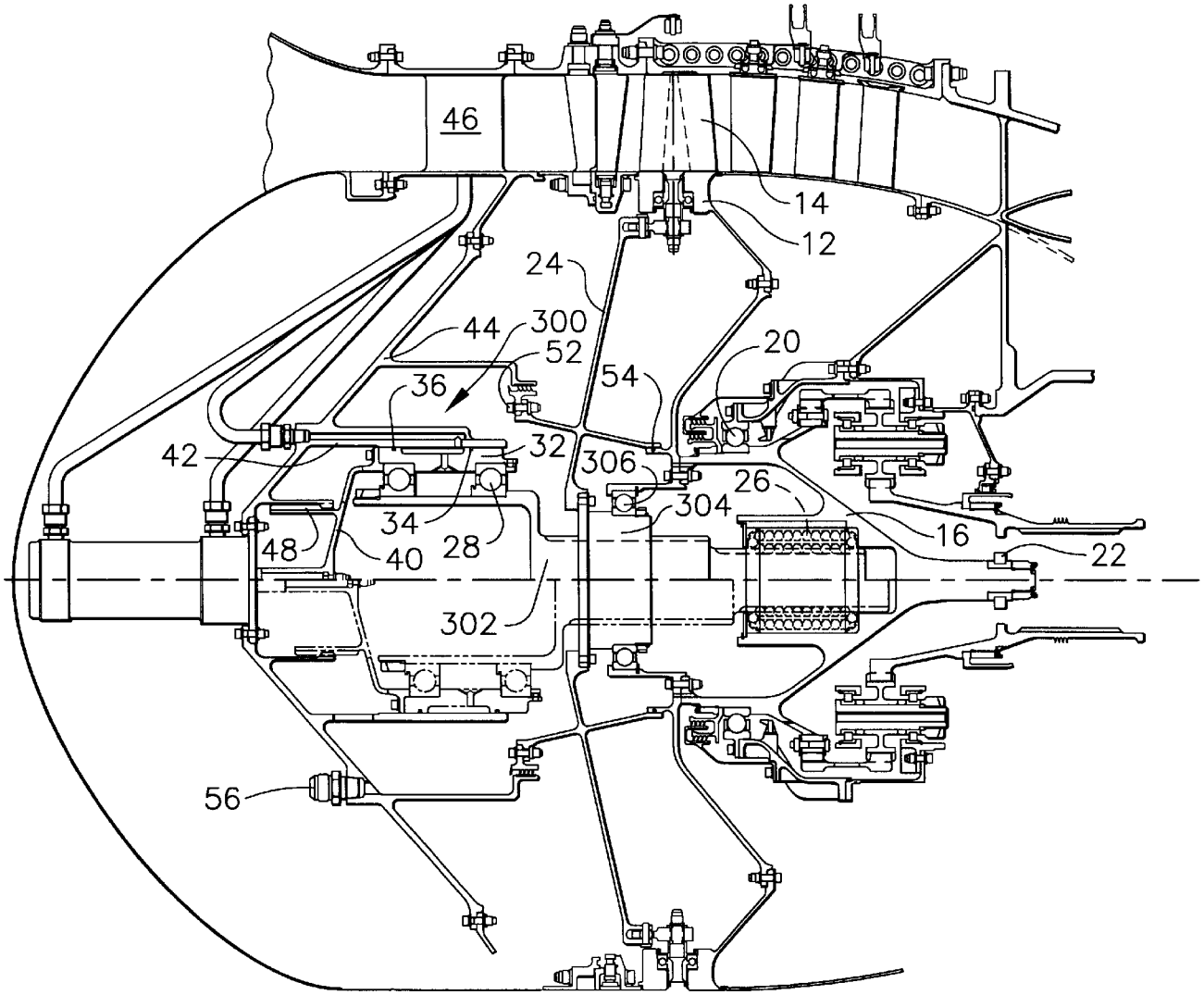
FIG. 8 is a schematic illustration of yet another rotor blade actuation system in accordance with one embodiment of the present invention.

FIG. 8 is a schematic illustration of yet another rotor blade actuation system 300 in accordance with another embodiment of the present invention. With system 300, and to actuate blade 14, actuation disk/cone 24 moves circumferentially instead of axially as in system 10 shown in FIG. 1. The axial motion of a rotating shaft 302 is converted to circumferential movement of the actuation disk/cone 24 via a set of male and female splines, oriented at an angle to the engine axis, contained in shaft 302 and sleeve 304 respectively. Any axial motion of sleeve 304 is prevented by thrust bearing 306.

The above described actuating systems enable transmission of a control signal for varying the blade pitch from a non-rotating area of the engine across a boundary to the rotating components. In addition, the above described blade support system provides adequate blade support to sustain the blade loads and at the same time allow the blade to rotate along its radial axis.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. Accordingly, the spirit and scope of the invention are to be limited only by the terms of the appended claims.

What is claimed is:

1. An actuation system for rotating a rotor blade in a gas turbine engine including a main disk rotatable on a main shaft, the rotor blade being secured to the main disk, said system comprising:

a blade support assembly coupled to and supporting the blade;

a crank coupled to said blade support assembly;

an actuating cone coupled to and rotatable with the main disk, said actuating cone movable axially relative to the main disk and coupled to said crank;

an actuator movable relative to the main disk and selectively engageable with said actuating cone;

a plurality of bearings for supporting said actuating cone; and a ring supporting said plurality of bearings.

2. An actuation system in accordance with claim 1 further comprising ball splines for coupling said actuating cone to the main disk.

3. An actuation system in accordance with claim 2 wherein said ball splines are co-axial with said actuator.

4. An actuation system in accordance with claim 1 further comprising a connecting cone coupled to said ring, said plurality of bearings comprising ball thrust bearings.

5. An actuation system in accordance with claim 4 wherein said crank is coupled to said ring so that axial movement of said ring imparts axial motion to said connecting cone.

6. An actuation system in accordance with claim 5 wherein rotation of said crank causes said actuating cone to rotate.

7. An actuation system in accordance with claim 1 wherein the blade includes a head and said blade support assembly comprises a transfer ring coupled to the blade head so that loads can be transferred from the blade to said blade support assembly.

8. An actuation system in accordance with claim 7 wherein said blade support assembly further comprises a bearing inner race support coupled to said transfer ring, and a thrust bearing positioned adjacent the blade head.

9. An actuation system in accordance with claim 1 wherein said actuating cone moves circumferentially relative to the main disk.

10. An actuation system in accordance with claim 9 wherein said actuator comprises concentric rotors, and said system further comprises a drive cone secured to the main disk and coupled to said actuator rotors.

11. An actuation system in accordance with claim 1 wherein said actuator comprises a piston contained within a rotating cylinder.

12. An actuation system in accordance with claim 1 wherein said actuator comprises an electric motor.

13. An actuation system for rotating a rotor blade in a gas turbine engine including a main disk rotatable on a main shaft, the rotor blade having a head and being secured to the main disk, said system comprising:

a blade support assembly coupled to and supporting the blade, said blade support assembly comprising a transfer ring coupled to the blade head so that loads can be transferred from the blade to said blade support assembly;

a crank coupled to said blade support assembly;

an actuating cone coupled to and rotatable with the main disk, said actuating cone movable axially relative to the main disk and coupled to said crank;

ball thrust bearings for supporting said actuating cone;

a ring supporting said bearings;

a connecting cone coupled to said ring;

an actuator movable relative to the main disk and selectively engageable with said actuating cone.

14. An actuation system in accordance with claim 13 further comprising ball splines for coupling said actuating cone to the main disk.

15. An actuation system in accordance with claim 13 wherein said crank is coupled to said ring so that axial movement of said ring imparts axial motion to said connecting cone.

16. An actuation system in accordance with claim 15 wherein rotation of said crank causes said actuating cone to rotate.

17. An actuation system in accordance with claim 13 wherein said blades support assembly further comprises a bearing inner race support coupled to said transfer ring, and a thrust bearing positioned adjacent the blade head.

18. An actuation system for rotating a rotor blade in a gas turbine engine, the gas turbine engine including a main disk, a plurality of rotatable blades, and a plurality of stationary vanes, the main disk rotatable on a main shaft, at least one rotatable blade secured to the main disk and movable between two adjacent stationary vanes, said system comprising:

a blade support assembly coupled to and supporting the rotatable blade;

a crank coupled to said blade support assembly;

an actuating cone coupled to and rotatable with the main disk, said actuating cone movable axially relative to the main disk a nd coupled to said crank; and an actuator movable relative to the main disk and selectively engageable with said actuating cone.

19. An actuation system in accordance with claim 18 further comprising:

ball splines for coupling said actuating cone to the main disk; and ball thrust bearings for support said actuating cone.

20. An actuator system in accordance with claim 19 further comprising:

a ring support said ball thrust bearings; and a connecting cone coupled to said ring.

21. An actuation system in accordance with claim 20 wherein said crank is coupled to said ring such that axial movement of said ring imparts axial motion to said connecting cone.

22. An actuation system in accordance with claim 21 wherein rotation of said crank causes said actuating cone to rotate circumferentially relative to the main disk.

23. An actuation system in accordance with claim 22 wherein the blade includes a head, said blade support assembly comprises a transfer ring coupled to the blade head permitting loads to be transferred from the blade to said blade support assembly.

24. An actuation system in accordance with claim 23 wherein said blade support system further comprises:

a bearing inner race support coupled to said transfer ring; and;

a thrust bearing positioned adjacent the blade head.

* * * * *